US011254080B2

(12) United States Patent
Le Monnier

(10) Patent No.: US 11,254,080 B2
(45) Date of Patent: Feb. 22, 2022

(54) METHOD AND DEVICE FOR SHAPING AND LOCKING SHELLS

(71) Applicant: IP3 GROUP, Saint Etienne (FR)

(72) Inventor: Jacques Le Monnier, Nuelles (FR)

(73) Assignee: IP3 GROUP, Saint Etienne (FR)

( * ) Notice: Subject to any disclaimer, the term of this patent is extended or adjusted under 35 U.S.C. 154(b) by 538 days.

(21) Appl. No.: 14/441,079

(22) PCT Filed: Oct. 29, 2013

(86) PCT No.: PCT/FR2013/000282
§ 371 (c)(1),
(2) Date: May 6, 2015

(87) PCT Pub. No.: WO2014/072591
PCT Pub. Date: May 15, 2014

(65) Prior Publication Data

US 2015/0290897 A1 Oct. 15, 2015

(30) Foreign Application Priority Data

Nov. 7, 2012 (FR) ..... 12 02980

(51) Int. Cl.
*B31D 5/00* (2017.01)
*B31F 5/00* (2006.01)
*B31B 50/44* (2017.01)

(52) U.S. Cl.
CPC ..... *B31D 5/00* (2013.01); *B31B 50/44* (2017.08); *B31D 5/0021* (2013.01);
(Continued)

(58) Field of Classification Search
CPC ..... B31D 5/00; B31D 5/0021; B31D 5/0039; B31D 5/0086; B31F 5/00; B31F 5/005
(Continued)

(56) References Cited

U.S. PATENT DOCUMENTS 3,978,774 A * 9/1976 Royal ..... B31B 50/00 493/168
3,995,736 A * 12/1976 Lawson ..... B65D 19/20 108/51.3

(Continued)

FOREIGN PATENT DOCUMENTS

EP 0 209 480 1/1987
FR 1 002 482 3/1952

(Continued)

OTHER PUBLICATIONS

PCT Search Report issued in PCT/FR2013/000282.

*Primary Examiner* — Sameh Tawfik
(74) *Attorney, Agent, or Firm* — Greenblum & Bernstein, P.L.C.

(57) ABSTRACT

Device for the manufacturing a block comprising a locking key and a folded shell that is scored and/or pre-grooved. The device includes a first device that includes at least one shaping device comprising a funnel having corner folding elements and at least a pressing element or a traction element. The at least one shaping device is configured to shape a sheet element into the folded shell so that corner edges of the sheet element are folded inwardly by the corner folding elements and sides of the sheet element assume a vertical position after the pressing or traction element applies a force to a center of the sheet element. A second device is utilized that includes at least a pressing element configured to insert the locking key into said folded shell so as to form said block.

19 Claims, 13 Drawing Sheets

(52) U.S. Cl.
CPC ..... *B31D 5/0039* (2013.01); *B31D 5/0086* (2013.01); *B31F 5/00* (2013.01); *B31F 5/005* (2013.01)

(58) Field of Classification Search
USPC ..... 493/91, 143, 144, 145, 147
See application file for complete search history.

(56) References Cited

U.S. PATENT DOCUMENTS 4,162,648 A * 7/1979 Kincheloe ..... B31D 5/00 229/103
4,273,548 A * 6/1981 Crane ..... B65D 5/004 493/162
4,303,405 A * 12/1981 Reichert ..... B31D 5/0004 493/90
5,350,066 A * 9/1994 Mendoza ..... B65D 19/20 108/51.3
5,918,744 A * 7/1999 Bringard ..... B65D 19/20 108/51.3
5,971,906 A * 10/1999 Tharpe, Jr ..... B65D 5/003 493/124
7,681,735 B2 * 3/2010 Youell, Jr. ..... B65D 19/20 108/51.3
7,731,028 B2 * 6/2010 Carroll, Jr. ..... B65D 73/0014 206/386
8,573,135 B2 11/2013 LeMonnier
9,126,721 B2 * 9/2015 Dye ..... B65D 19/38
9,211,972 B2 * 12/2015 Kizer ..... B65D 5/64
2006/0205579 A1 * 9/2006 Boix Jaen ..... B31B 50/00 493/143
2013/0032065 A1 2/2013 LeMonnier

FOREIGN PATENT DOCUMENTS

FR 2 958 630 10/2011
JP 6373855 B2 * 8/2018 ..... B31D 5/0021

* cited by examiner

METHOD AND DEVICE FOR SHAPING AND LOCKING SHELLS

CROSS-REFERENCE TO RELATED APPLICATIONS

The instant application is a US National Stage of PCT International Application No. PCT/FR2013/000282 filed Oct. 29, 2013 and claims the priority benefit under 35 USC 119 of French Application No. 12 02980 filed on Nov. 7, 2012.

BACKGROUND OF THE INVENTION

1. Field of Invention

The present invention relates to the technical sector of machine methods for the purpose of forming and assembling blocks. In particular in order to form block systems, according to the patent FR 1002482 filed on 26 Nov. 2010 with a filing PCT/IB2011/000808. However, it is not limited to this. Patent FR 1002482 concerning devices of the load-supporting type made from material of the cardboard type, resistant to pressure forces.

That is to say the invention relates to a technical solution of methodologies and tooling, limiting human intervention "by highly repetitive manual actions". The invention therefore concerns a remarkable machine, able to be developed over time, with the available material and technological way. Using cardboard sheets or any other material suitable, the invention, applied to any machine suitable for this purpose, makes it possible to progressively shape block patterns. That is to say mainly a shell and a locking key, according to the prior patent named above.

2. Background Information

Industrial machine devices are known for folding cardboard or any other similar material, in order to construct cases or slotted boxes, in order to produce any objects by way of a folding, cutting, gluing and stapling system. This is because, on conveyors, grooves and cuts are produced, and then pressure systems shape the cartons. Then gluing and stapling systems consolidate the assemblies in order to make volumes from them, such as boxes provided with gluing joins for example.

These machine systems therefore make it possible to shape a large number of objects made from cardboard or any other material that may be suitable. "Fefco" designs are mainly the volumes possible to be shaped using these already existing machines, being very numerous on the market. It is obvious to manufacture machines for products sold on the market. However, one of the major drawbacks of these machines is that they are not suitable for shaping and constructing cardboard blocks according to the patent FR 1002482. This is because this system of blocks is entirely novel and remarkable on the industrial market. It is therefore obvious that no one has yet invented such a machine since the markets did not exist previously.

Certainly, these machines could produce for example quite small boxes in order to form a kind of block. However, these would not have the performances, such as impermeability, nor the resemblance to the blocks named in the patent FR 1002482, the shell being in a single piece, assembled without glue, without staple, without adhesive or any accessories. Which is what existing machines precisely claim.

Through experience a person skilled in the art therefore does not sufficiently know the system of blocks according to the patent FR 1002482. This is because it is not possible to manufacture the blocks according to the patent FR 1002482 using existing machines available on the market. Otherwise the invention will not have any reason to be.

For example, these already existing machines could manufacture small slotted boxes but these would not be impervious at the bottom. The joining lug would be joined with hot glue. The cuts, openings and slots would also prevent perfect mechanical sealing. It would also need adhesives to close the bottom. The very limited or even impossible possibilities of these machines for constructing block shapes according to the patent FR 1002482 can quickly be seen.

According to the patent FR 1002482, the block shapes, which are therefore novel and remarkable on the market, have not been commercially available for long. It is certainly for this reason that the solution consisting of a machine and methodologies open to development does not exist. The present invention offers an effective manufacturing methodology, which is consequently unique and remarkable, on the basis of a really novel and innovative machine.

There therefore exists a real need to create a novel manufacturing technique, represented by a novel machine open to development according to the available materials and technologies. The first device presented is therefore basic with regard to the operating scheme but could receive all possible and existing improvements to make it quicker and more effective in an industrial environment.

Forming blocks according to the patent FR 1002482 is an obvious novelty, moreover cited by the various search reports as being innovative, novel and able to be manufactured industrially. However, up to the present time, the machine did not exist. The present invention claimed therefore proposes this great innovation and novelty.

Forming blocks with existing machines such as folding/gluing machines to form slotted boxes is therefore completely unsuitable. The existing methodologies did not lend themselves to this.

Why: In fact, the block patterns according to the patent FR 1002482 are formed from the base, by the bottom and not by the sides. Current machines available on the market in no way propose this type of know-how. Since these cannot construct blocks commencing quite simply with a bottom, using a vertically oriented pressure way, in a kind of tunnel or a so-called funnel, becoming narrow.

SUMMARY OF THE INVENTION

In fact the invention is a throttling system for constraining the material. With a vertical pressure pressing on the bottom of the shell or by traction on the outside of the bottom of the shell in order to form the block.

Non-limiting embodiments of the invention include a device for manufacturing a block comprising a locking key and a folded shell that is scored and/or pre-grooved, wherein said device comprises a first device that includes at least one shaping device comprising a funnel having corner folding elements and at least a pressing element or a traction element. The at least one shaping device being configured to shape a sheet element into the folded shell so that corner edges of the sheet element are folded inwardly by the corner folding elements and sides of the sheet element assume a vertical position after the pressing or traction element applies a force to a center of the sheet element. The funnel being configured to gradually shape the folded shell into a cubic shape as the folded shell descends. A second device that includes at least a pressing element configured to insert the locking key into said folded shell so as to form said block.

BRIEF DESCRIPTION OF THE DRAWINGS

The following figures show aspects of the invention as follows.

DETAILED DESCRIPTION OF THE INVENTION

Figure 1:
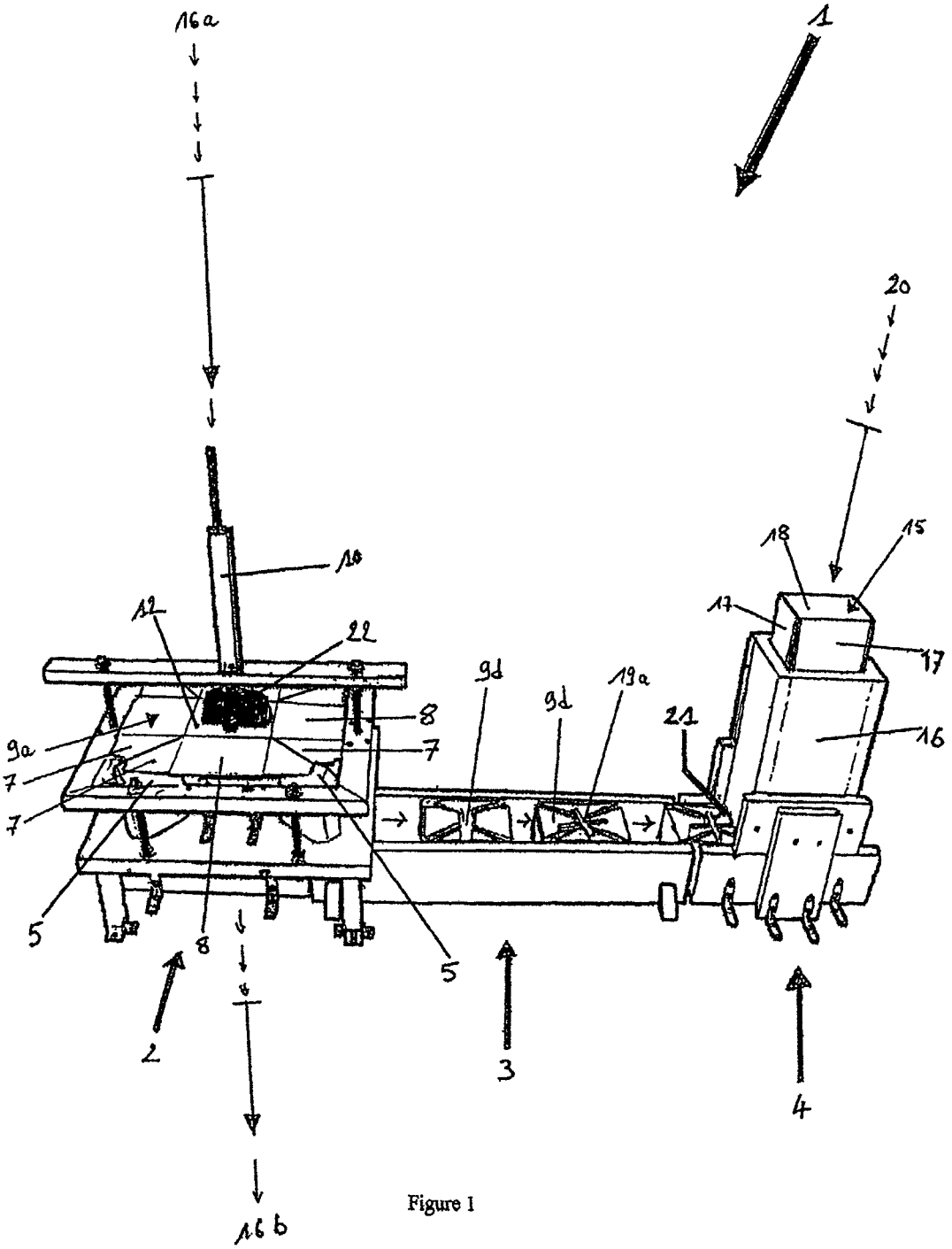
FIG. 1 depicts the cyclic principle of the basic machine.

The present invention being methodical methods, represented by a machine that is initially basic (1). However, clearly representing a novel technique for deforming sheets in order to form shells by a pushing pressure. That is to say a solution of technical methods, and therefore a machine open to development, making it possible to shape the blocks by acting mainly with vertical pressures and vertical tractions, from the bottom of the shell being formed, guided by a so-called funnel, forcing the material to be folded. Then making it possible to place locking keys at the end of the line, in order to definitively form the block volumes.

The method commences with the deformation (2) of the sheet (9*a*), intended to form the shell of the block. Once the shell is finished (9*d*), it falls onto any conveyor (3) that keeps its volume. Since the conveyor has suitable walls, the shell does not open. During passage on the same conveyor, a reinforcement cross bar (19*a*) may be deposited or not. Then the shell, equipped with any cross bar, enters under the bottom of a tunnel (21) in order to receive therein the locking key (4). However, before this, by way of devices, the inside of the shell may receive sprays of glue in order to make the block non-demountable, once the locking key is fitted. By way of an optional module, printing can also be applied during passage on the conveyor (3).

The representation of the machine is not limitative in terms of form or technology, and a person skilled in the art would quickly be able to make improvements thereto such as rams, electric rollers, conveyors or articulated arms for the purpose of improving the efficiency of the machine. However, the basic principles are indeed present, real and effective with this inventive methodology for shaping and closing.

Hereinafter, the only case dealt with will be an elementary machine that encompasses all the others, by obvious technical equivalence, such as for example machines assisted by electric, hydraulic or pneumatic pushing way. Electric conveyors. Assisted by electronic and computerised systems. A person skilled in the art would be able to improve the whole in order to make it much more efficient than the machine depicted in FIG. 1.

FIG. 1 depicts the cyclic principle of the basic machine (1). Entirely preferred in order to explain the inventive principles of fundamental and elementary methodologies. Three basic modules: said funnel and pressing mechanism (2), any conveyor (3) and the system for closing the block (4).

Figure 2:
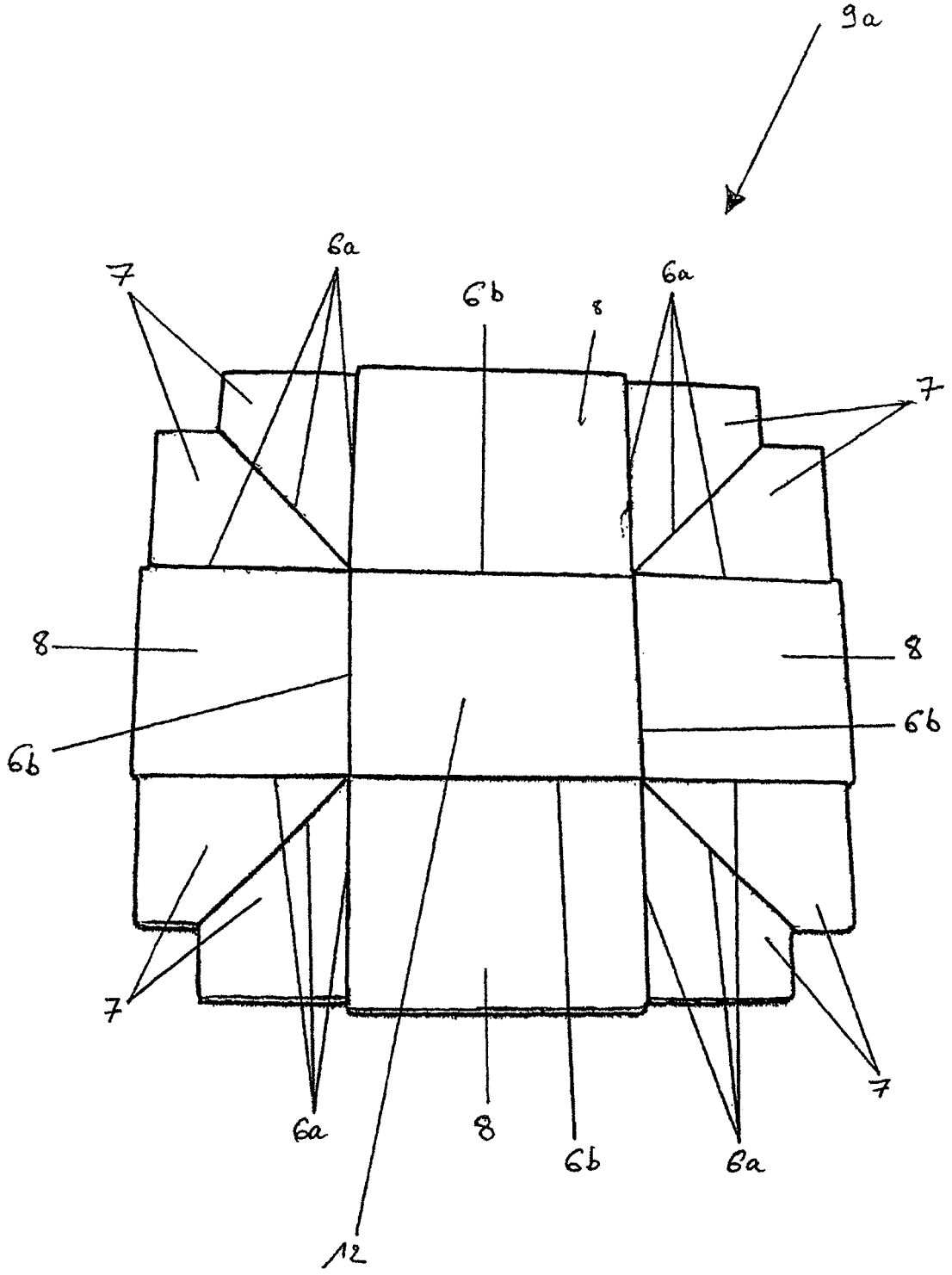
FIG. 2 shows a cardboard sheet flat.

FIG. 2 shows a cardboard sheet flat (9*a*), or any other material lending itself to this. A scored sheet, having previously received grooves for assisting, on deformation, its shaping, as a future shell.

Figure 3:
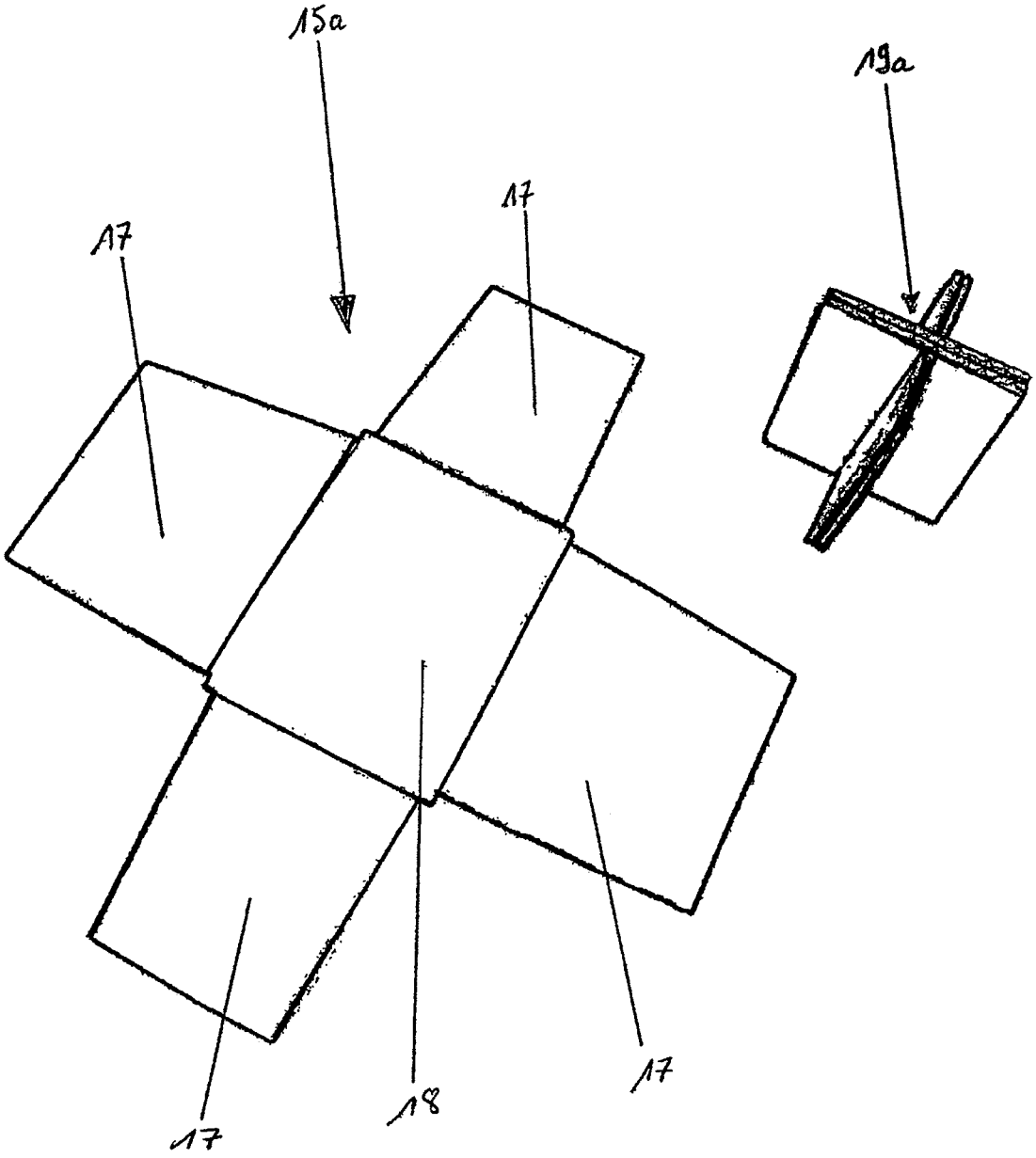
FIG. 3 depicts a flat rigid cardboard sheet.

FIG. 3 depicts a flat rigid cardboard sheet or any other material lending itself to this. The form corresponds to a locking key (15*a*).

In the form of a cross, in relief, the object corresponds to a non-limitative pattern for reinforcement in cardboard, mounted, able to be installed in the shell.

Figure 4:
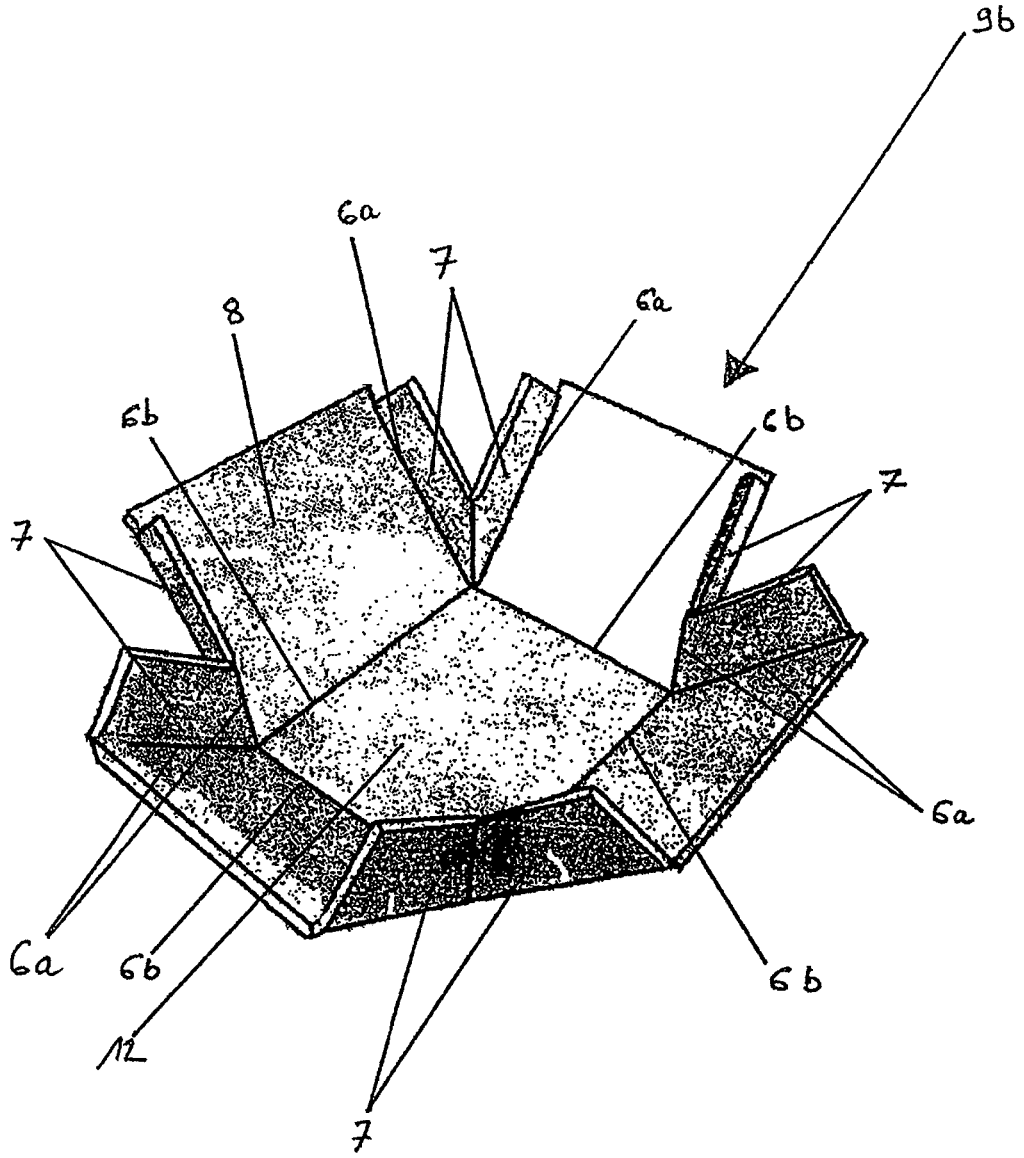
FIG. 4 depicts partially FIG. 2.

FIG. 4 depicts partially FIG. 2 but having undergone pressure effects by pressing on the bottom, for the purpose of deforming in order to obtain a shell (9*b*) being the deformed sheet.

Figure 5:
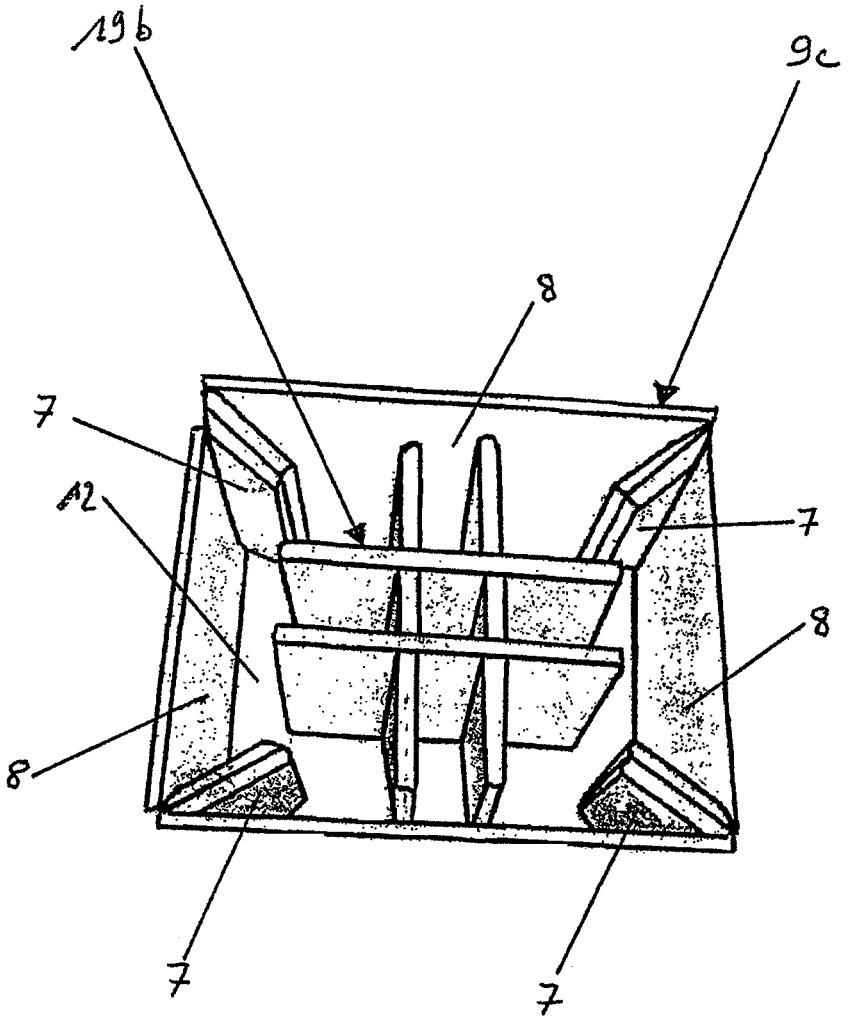
FIG. 5 depicts the formed shell, following passage through the funnel and then having received a reinforcing cross bar pattern, placed inside it.

FIG. 5 depicts the formed shell, following passage through the funnel and then having received a reinforcing cross bar pattern, placed inside it. (9*c*) is any shaping of the sheet (9*a*), represented by a shell. (19*b*) being any cross bar.

Figure 6:
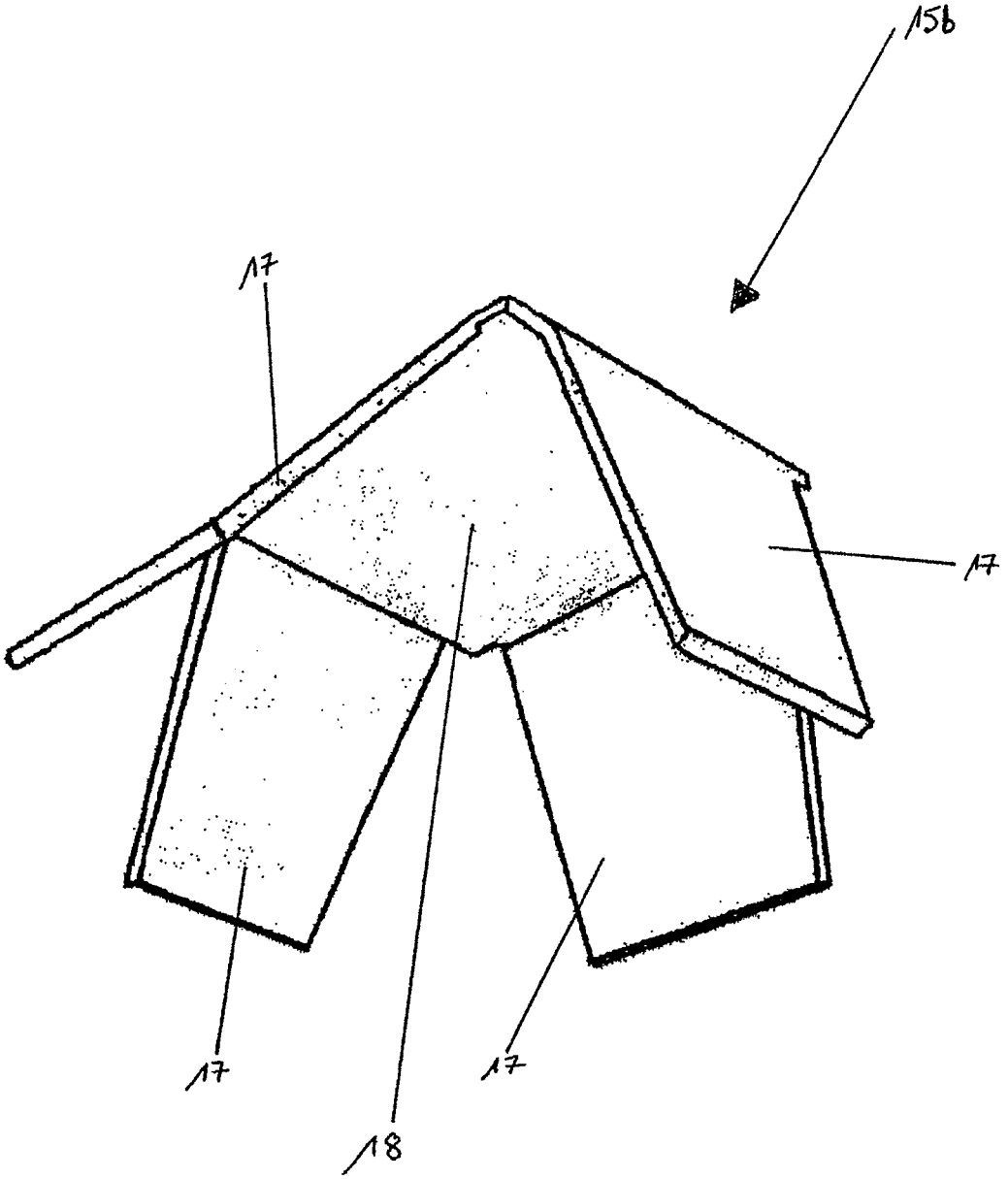
FIG. 6 depicts FIG. 3, precisely the locking key but having undergone pressure effects in order to deform it for the purpose of progressively obtaining the form for entry into the shaft or tunnel of the machine.

FIG. 6 depicts FIG. 3, precisely the locking key but having undergone pressure effects in order to deform it for the purpose of progressively obtaining the form for entry into the shaft or tunnel of the machine. This locking key making it possible to lock the structure of the block at stage (21). (15*b*) being the locking key formed.

Figure 7:
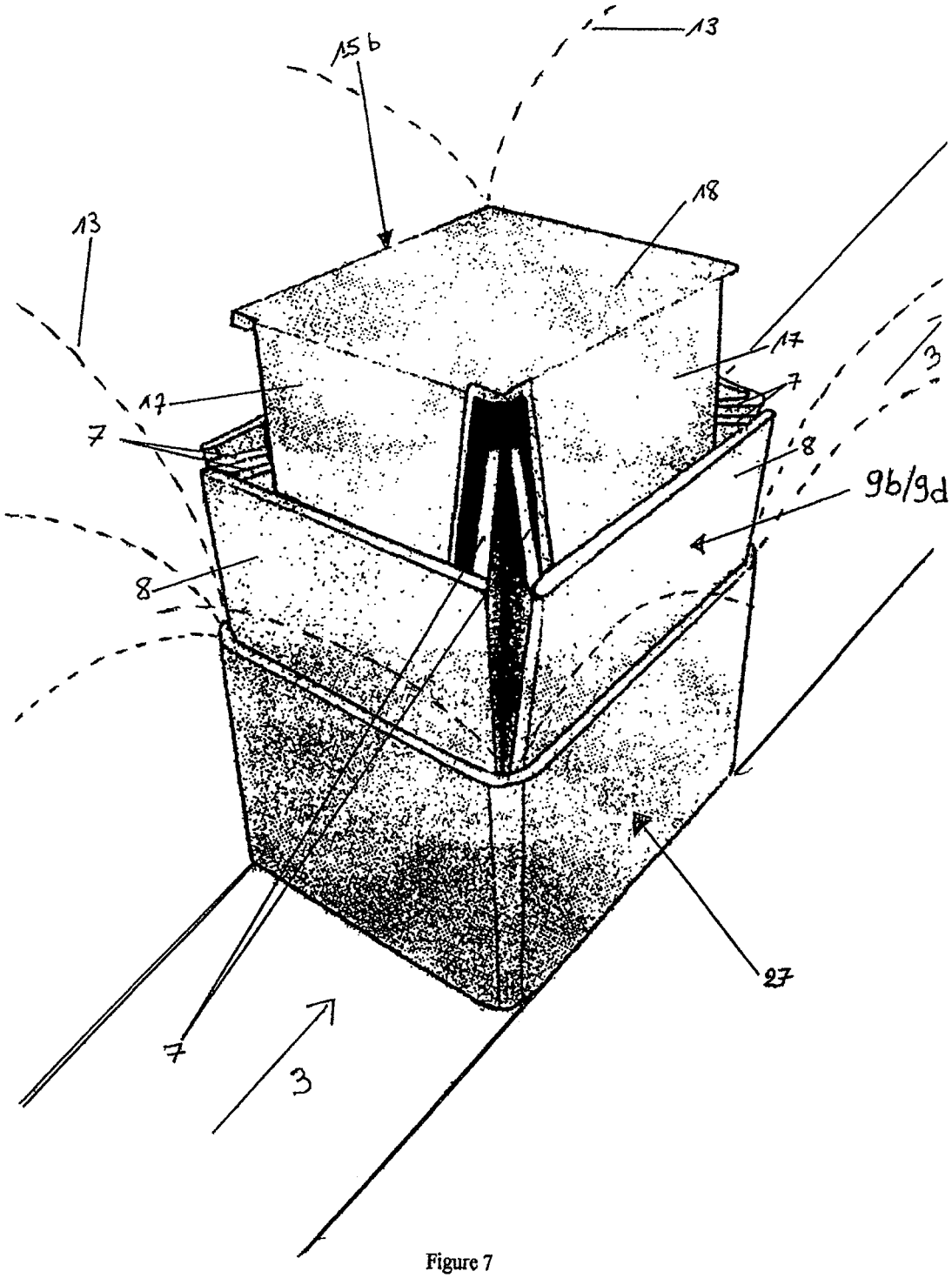
FIG. 7 depicts FIG. 4 that receives FIG. 6.

FIG. 7 depicts FIG. 4 that receives FIG. 6, at the end of travel (21), at the end of the shaft of the machine (4) in order to form the block definitively by fitting together.

The end of the passage (27) of said funnel is also depicted therein, showing the end of passage of a very narrow funnel in the part of the machine (2), obliging the sides (8) and the corners (7) of the shell (9*b*) to be erected towards the inside. The broken lines (13) represent the shape of a virtual funnel top ending in the form (27) being any end of said funnel. (9*b*) or (9*d*) entering in (27) being the throttling spout of said funnel. (9*b*) is a sufficient correspondence to the sheet (9*a*). This being shaped in order to become a shell.

Figure 8:
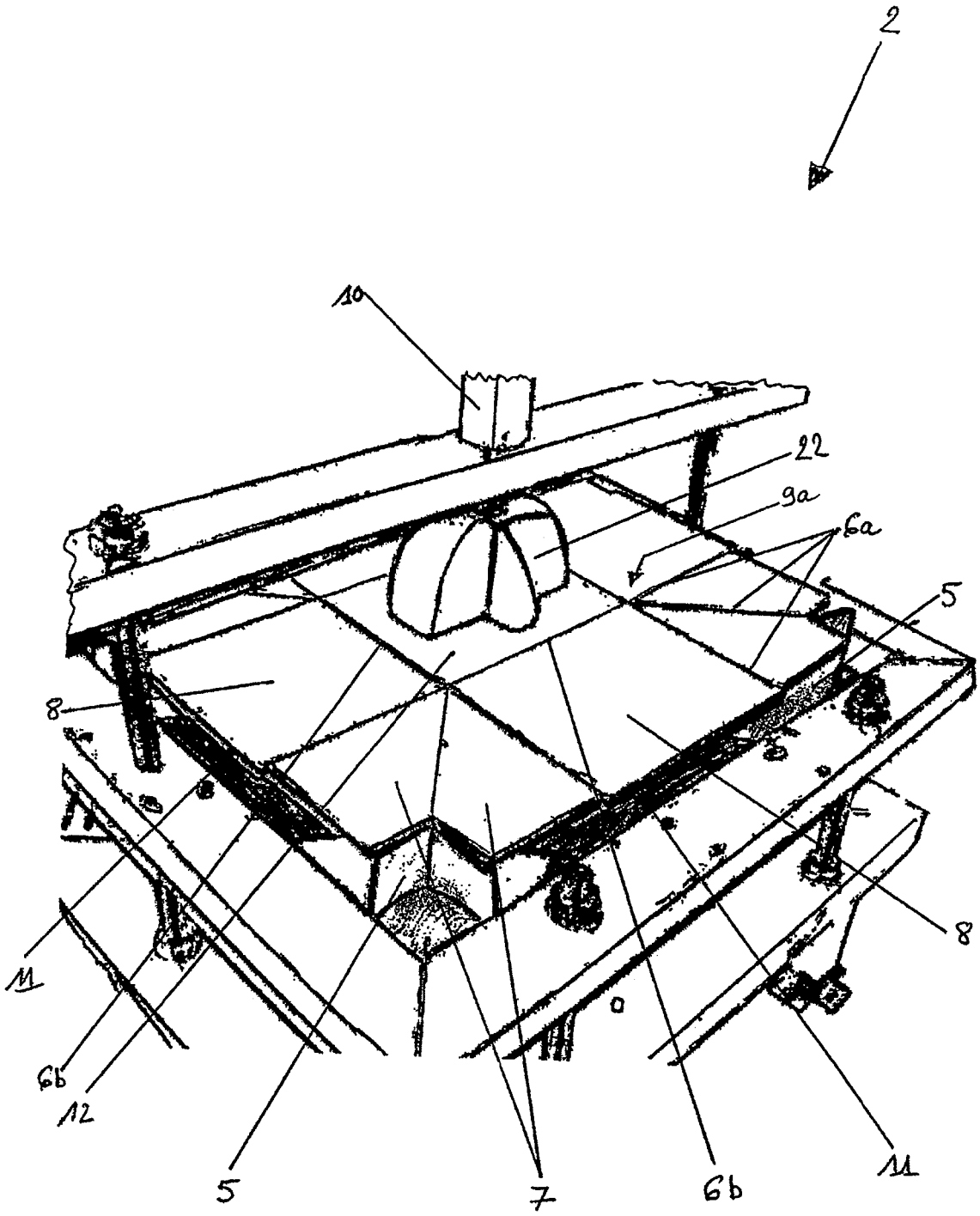
FIG. 8 depicts the cardboard sheet intended to form the shell.

FIG. 8 depicts the cardboard sheet (9*a*) intended to form the shell. Situated at the very top of the funnel (2) and which will be compressed by the ram (10), pressing on the rectangular bottom (12) of the future shell by way of any tool (22).

Figure 9:
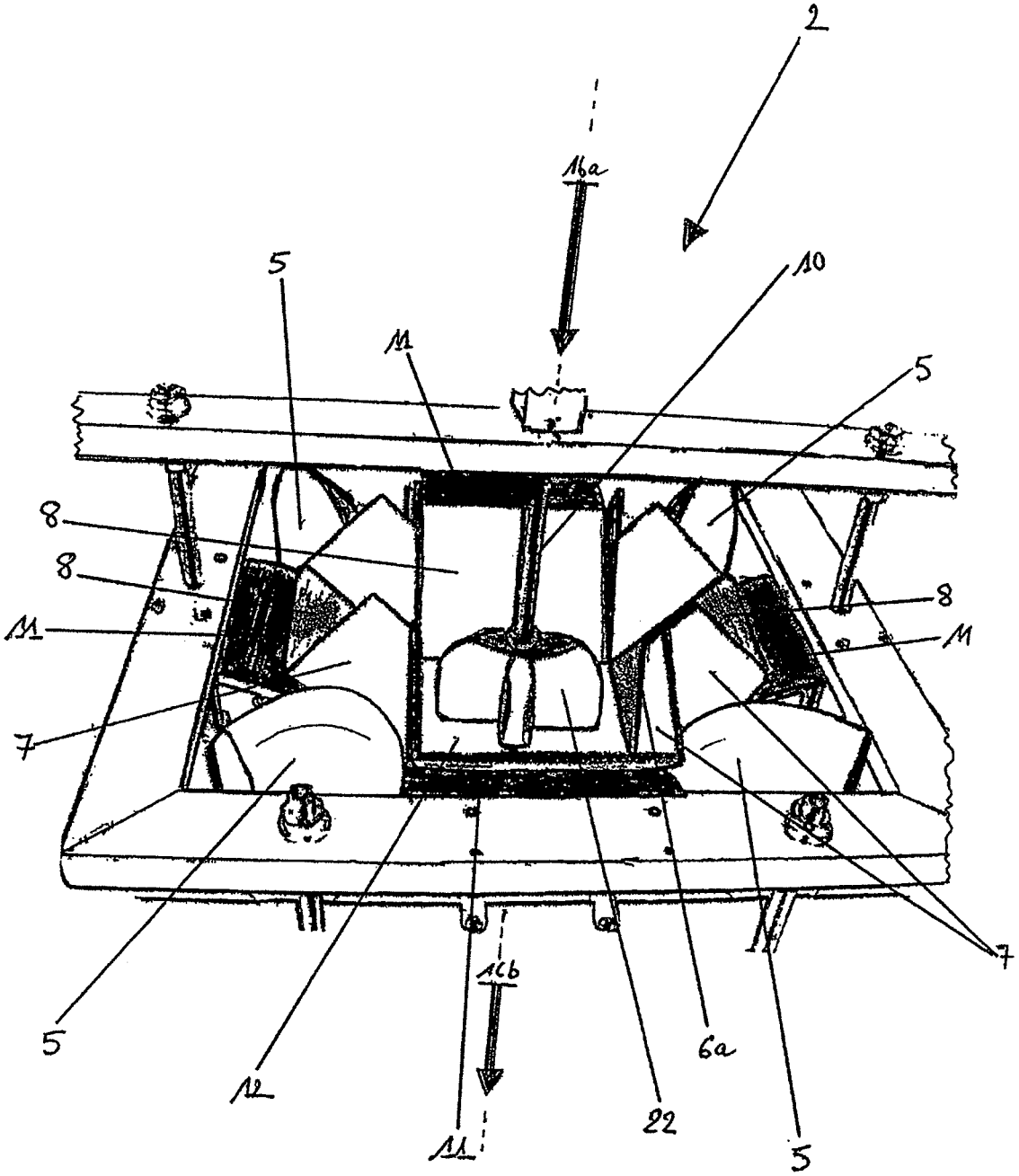
FIG. 9 shows the cardboard sheet during deformation and entering the funnel.

FIG. 9 shows the cardboard sheet (9) during deformation. Entering said funnel (2), being forced to pass therein and to descend therein. Deformation triggered by the pressing of the ram (10) on the bottom (12) of the future shell. The acute angles (5), in the form of a protrusion on the funnel, help to deform the sheet and to guide the corners (7). Then the four so-called slides, edges or runners (11) guide the four edges (8) of the shell in order to go towards the bottom of the funnel, while being erected. The edges (8) on the corners (7) are folded over towards the inside of the shell (9*d*).

Figure 10:
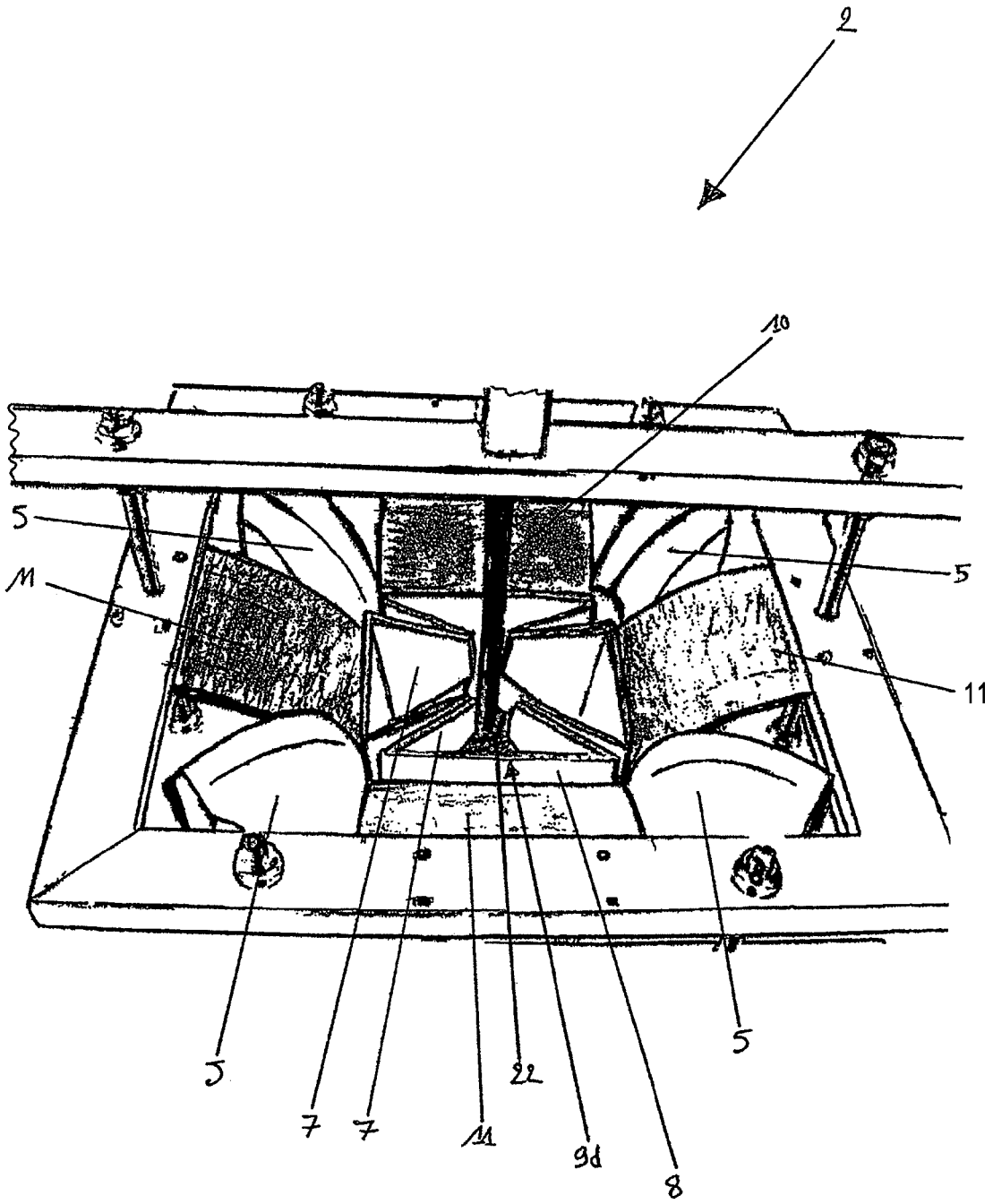
FIG. 10 shows the cardboard sheet that is in the process of definitively adopting its shell shape by way of the guidance of the four slides and the end of said square or rectangular funnel.

FIG. 10 shows the cardboard sheet that is in the process of definitively adopting its shell shape by way of the guidance of the four slides (11) and the end of said square or rectangular funnel (27). The shell (9*d*) will disappear under the funnel in order to be received on the conveyor (3), once it has passed into the end of the part (27) of said funnel.

Figure 11:
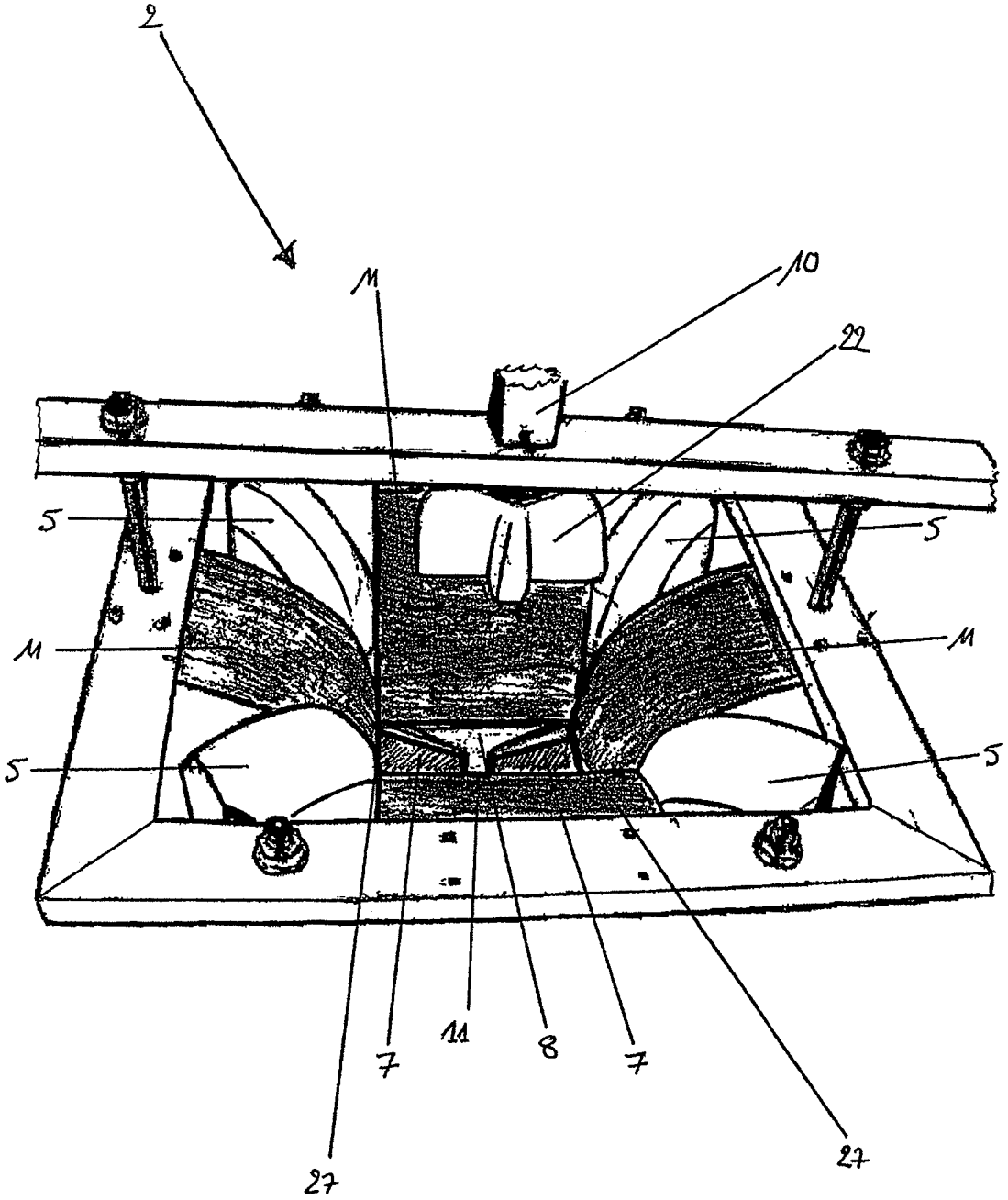
FIG. 11 depicts the shell in the process of disappearing into the bottom of the narrow part of the funnel.

FIG. 11 depicts the shell (9*b*) in the process of disappearing into the bottom of the narrow part (27) of the funnel (2). The conveyor (3) or the channel receives the shell. The edges of the conveyor locking underneath and sufficiently vertically aligned with the edges (8) of the shell. The corners (7) being retracted in the shell (9*d*).

Figure 12:
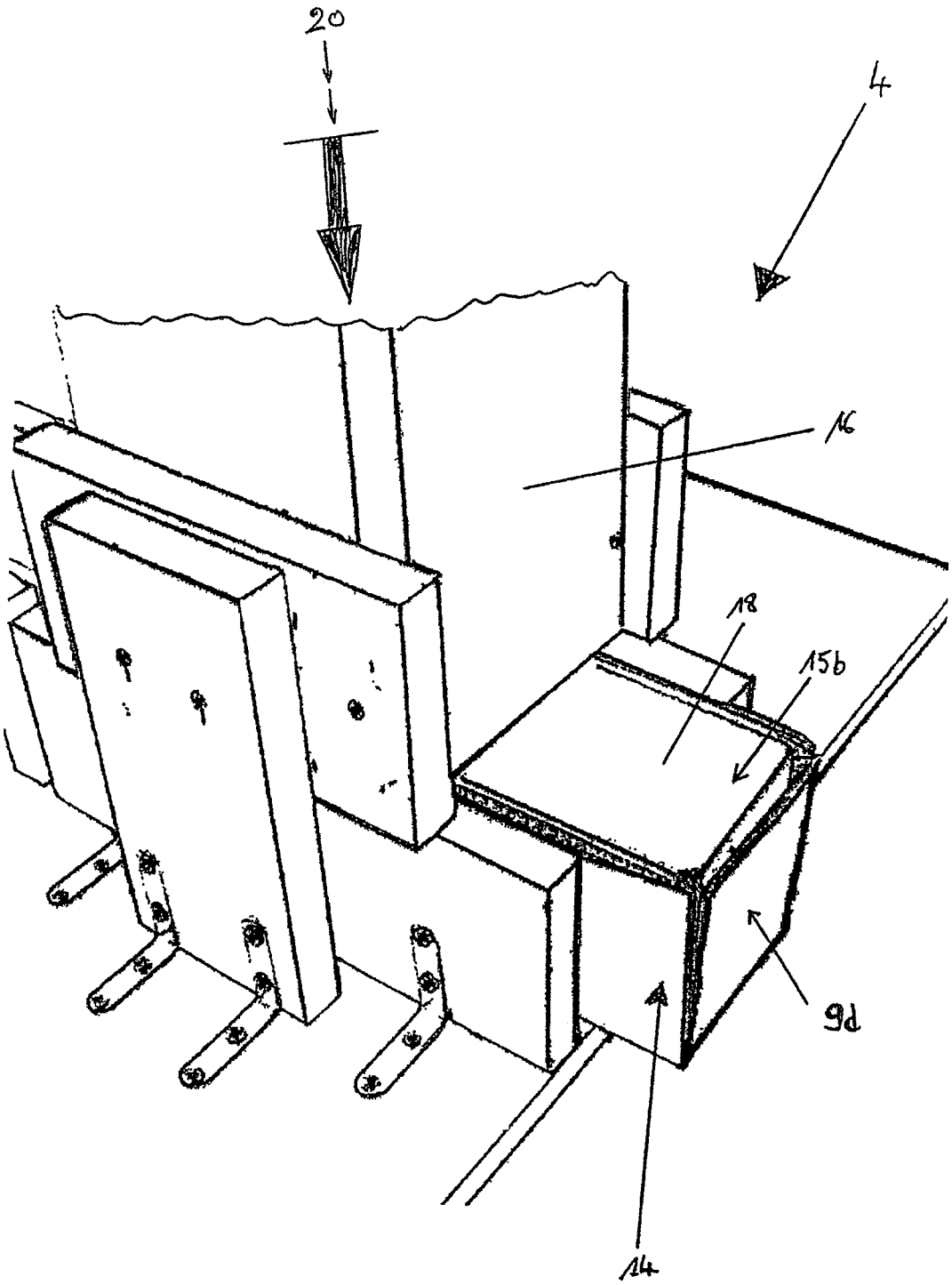
FIG. 12 depicts the finished block at the discharge from the conveyor and at the discharge from the locking, by the descent of the locking key in the shaft or tunnel.

FIG. 12 depicts the finished block (14) at the discharge from the conveyor and at the discharge from the locking, by the descent of the locking key (15*b*) in the shaft or tunnel (16) coming to perfectly slide in the shell by way of a positive vertical pressure (20) bearing on the top surface (18) of the locking key. The locking key having undergone sufficient pressure to nest and fit in the shell (9*b*), (9*c*), (9*d*). The shaft is therefore adapted and proportioned to the surface (18). This is much less wide than the open space of the top of the shell (9*d*). Automatically, the flaps (17) of the key (15*b*) enter inside the shell (9*d*), pressing inside and vertically, against the sides (8). The block 14 is formed. The block (14) is therefore represented by the fitting of (15*b*) in (9*d*), by virtue of the vertical pressure (20), which was guided on (18). (9*d*) is shown in FIG. 1.

Figure 13:
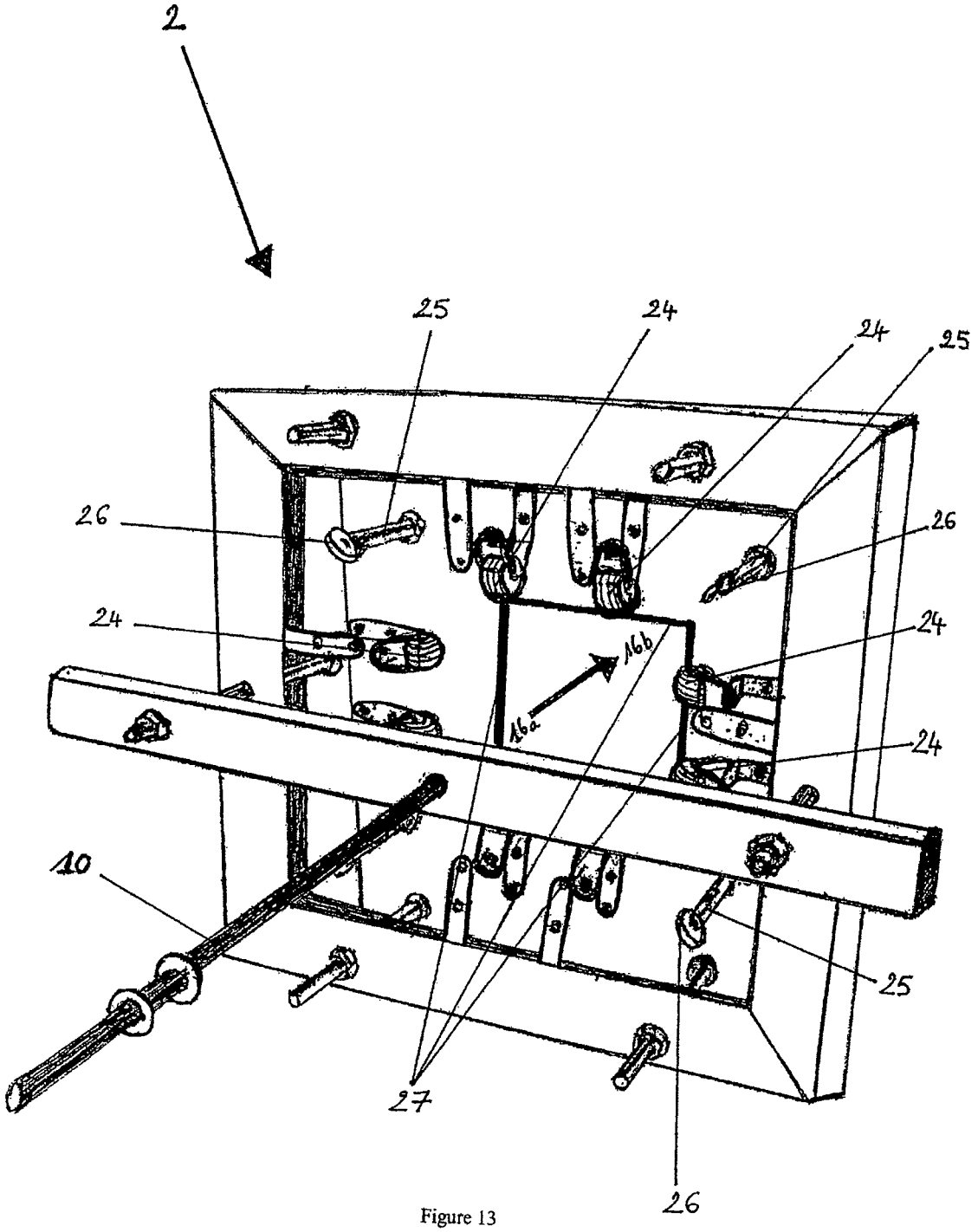
FIG. 13 shows an optional solution of modules.

FIG. 13 shows an optional solution of modules and of the funnel type, equipped with electric rollers (24) or not, pushing blades (26) in the corners, assisted by pneumatic rams (25), for the purpose of accelerating the process of folding and guiding but always with a pressure (16*a*) on the bottom or traction (16*b*) through the bottom of the shell. The form of said funnel is always evoked in order to prefold the shell in a single pass. In this figure, neither slides (11) nor acute angles (5) appear but the system functions just as well since it simulates, all or part, at a given instant, the form of said funnel. (24), (25), (26) may be complementary to (5), (11).

As can be observed in FIG. 1, the part (2) of the machine designates a funnel system making it possible to shape the shell of the block by a pushing system (16*a*) bearing by way of the tool (22) on the bottom of the inside (12) of the shell, still in the rigid sheet (9*a*) state, and then a throttling (27) occurs at the end of travel for the purpose of deforming this same plate becomes (9*b*), (9*d*), aided by the deformation of the acute angles (5) and edges or runners (11). We know funnels for pouring a liquid or powders for example, into a bottle or any receptacle. The present remarkable invention makes it possible to introduce, into said funnel (2), a very solid element that is in fact a sheet (9*a*). By way of the throttling (27) and the mechanical deformation constraint way (5) and (11), to form a shell (9*b*) therefrom, by reducing the exit space at the end of travel. The edges (8) and the corners (7) are folded towards the inside and enter the shell (9*d*).

In FIG. 10, the funnel is rectangular or square in shape, provided with forms preferably adapted to the corners (5), making it possible to raise the triangles or angles (7) of the sheet and subsequently the four sides (8) referred to as the lateral walls of the shell, sides forced to lift through the size of the four said slides (11) situated in front of the throttling spout (27). Deformation is assisted by the grooves (6*a*) and (6*b*) provided on the sheet (9*a*). By descending pressure (16*a*), by pressing (22) on the bottom (12) of the shell of the block. The cardboard sheet enters a passage that is more and more narrow, at the end of travel in the funnel taking the form of the shell (9*c*) with shapes of a rectangular or square type.

Next the pushing ram or pusher (10) quite simply withdraws.

Or a traction system can be secured on the outside at the bottom (12) of the shell (9*a*). For example, a sucker system can have the same effect but from underneath the machine. Such as for example by suction generating a vacuum by way of a vacuum pump, making it possible to pull instead of push the surface (12) of the sheet (9*a*). If the pump is stopped, the sucker or suckers release their grip. In this way the ram is reversed, thus situated under the machine. Ram (10) placed under the machine, potentially equipped with suckers in order to be pressed against the external bottom (12) of the shell and working in negative pressure (16*b*).

In FIG. 1, the part (2) of the machine will therefore be referred to as a kind of funnel, with a channel splayed at the top and narrow at the bottom. Forming a throttling system (27). Formed so as to guide and assist the deformation of the cardboard sheet or any other material that may lend itself thereto in order to construct blocks (14) for example, and according to the patent FR 1002482 also filed as PCT/IB2011/000800 or any other similar object.

The part of the machine (2) is in fact a module, separable from and independent of the rest of the machine, able to be represented by a specific physical funnel shape.

For example, still assisted by a thrust (16*a*) or by traction (16*b*) on the bottom of the sheet in a so-called funnel. It can be assisted potentially by complementary machines such as micromotors, rams or electric rollers, able to give virtually shapes, generating folding forces at given geometric points, defining the ideal shape of the funnel in order to deform the sheet and assist it in sliding towards the narrow bottom (27), taking the gradual shape of the shell, that is to say (9*a*, 9*b*, 9*c*, 9*d*).

In FIG. 8, the cardboard sheet (9*a*) rests on four corners (5), preferably acute and rounded. In fact, these suitable shapes (5) are positioned at the top and in the corners, commencing to form the throttling spout of the funnel (2). The corners (5) and the four walls (11) of the mould or funnel can be assisted mechanically, and may be composed on one or more parts made from plastics material, wood or metal for example. In fact any type of material can be adapted thereto, such as abutments, rams equipped with forms, or any blades for the purpose of deforming the material. Pneumatic, hydraulic or electric rams may trigger thrusts in order to fold over the material of the shell (9*a*, 9*b*, 9*c*) towards the inside of the centre in order to accelerate the descent process caused by the thrust of the ram (10). In order to assist the corners (5) of said fold in breaking and folding over, grooves (6*a*) and (6*b*) on the sheet (9*a*) are provided for this purpose. Making it possible to fold over the triangles or angles (7) of the future shell (9*a*, 9*b*, 9*c*) towards the inside thereof. Any thrust rams, installed at suitable points, can therefore assist and aid for folding over the corners (7) and sides (8) of the shell (9*a*) towards the inside, always for the purpose of accelerating the descent of the shell in the narrow part of the funnel (27).

The cardboard sheet (9*a*) or any other material that can be used can therefore be installed on the surface of the funnel (2) or of said mould provided for this purpose.

In FIG. 9, the evidence of a vertical pressure (16*a*) with the funnel having its corners (5) and slides (11) is broadly sufficient to form the shell. By way of a pressure (10), (22) on the bottom of the future shell the sheet starts to be shaped while entering a funnel. The triangles (7) of the shell are folded inwards as well as the four walls (8) being erected vertically.

A pressing device (10) therefore effecting a vertical pressure on the rectangle (12) or square (12) of the sheet (9*a*), intended to be the bottom of the shell (9*c*) or (9*d*). But also, optionally, it is possible and obvious to be able to press through the outside bottom of the shell by the suction device or by way of a hook, perforating the shell for example with a worm. The negative traction force (16*b*) is the same as the positive thrust force (16*a*). The sheet descends in the funnel and is formed as a shell. It is quite simply pulled.

In FIG. 13, the use of roller or blade device or various metal parts makes it possible to form the funnel preferably in a square or rectangular shape. In order to accelerate the folding phenomena, simultaneously with the thrust (16*a*) or traction (16*b*) of the bottom, any rams can therefore assist in pushing the walls and corners of the sheet in order to form the sides (8) of the shell (9*c*) or (9*d*) as quickly as possible. Any electric rollers, placed at suitable points, such as for example in place of the slides (11), also accelerate the downward descent, in order to reach the spout (27) of the module (2).

Once the invention is disclosed to the public, a person skilled in the art will be able to improve the system of the machine but still keeping the fundamental principle of thrust or traction in order to lead the shell towards the bottom of the fold, creating a throttling, necessitating directed folding forces, for the purpose of forming a shell at the discharge from the module (2).

In FIG. 10, part of the invention therefore consists of deforming sheets with specific funnel shapes. Funnels assisted by appliances as named above. Not being limitative, assisted by grooves (6*a*) and (6*b*), studied as on the cardboard sheet (9*a*) or any other material that can deform, following the narrow passage in a specific funnel, adapted for this purpose. Adaptation of acute protrusions (5), rounded shapes (11), any tools making it possible to assist the deformation of the material, with the assistance of the pusher (10) by positive or negative pressure. The rounded acute angles (5) and the slides (11) do indeed represent the funnel phenomenon and in any other form depicted.

In FIG. 11, the invention therefore consists of using a progressive and sufficient pressure, emitted on a surface, generated by a thrust (16*a*) or by traction (16*b*). The energy of the pressure that is to be dissipated generates a deformation in the cardboard sheet (9*b*). The grooves (6*a*) in the corners of the cardboard sheet are the first weaknesses, therefore giving rise to the guided deformation. The deformations are immediately guided by protrusions or any forms of the slide type (11) or any assistance thrusts, necessarily orienting the material towards the centre of the funnel (27). In fact, the sheet deforms progressively while descending in the funnel but takes the form imposed by this same funnel specific to this novel technology. In the four corners of the funnel, acute and rounded angles (5), represented by forms preferably made from metal but not limitative, are dominant in order to break the preformed edges (6*a*) on the cardboard sheet (9*a*), as soon as the thrust or traction process starts.

The four corners (8) of the sheet, preformed by grooves (6*b*), being attached to the four corners, lift automatically, driven towards the centre of the funnel. The four walls, referred to as slides (11), smooth but at the same time rounded, of the funnel, cause the four faces (8) of the shell to be lifted. The funnel, adapted to the shape of the block, therefore lifts the four sides (8) of the shell. The final narrowing (27) of the passage of the funnel perfectly matches the rectangular or square form of the definitive shape of the shell (9*c*) or (9*d*).

In FIG. 7, once the triangles of the shell have entered, according to (9*b*), (9*c*) or (9*d*). Naturally the four faces of the sheet are lifted, going vertical, and can directly be oriented towards the bottom (27) of the funnel. Similar dimensions, but broadened at said funnel, by a few millimetres, are provided for the correct sliding and correct passage of the shell at the end of travel, during the very narrow passage (27) in the end of said funnel, in order to form the shell. The locking key can also be installed therein during passage through the funnel (2). Sufficient pressure by the positive ram system (16*a*) would make it possible to deform, to form and then, by a second operation to close the block. In fact, a first pressure forms a shell, and the ram retracts. Next, the locking key (15*b*) is installed therein and then the ram returns to press on the surface (18) in order to press the locking key definitively into the shell. We have the same result represented by the fitting of (15*b*) in (9*d*). Making it possible to save on the operation performed with FIG. 12, that is to say the module (4) can potentially be omitted from the whole of the machine (1).

In FIG. 1, once the shell is formed, at the discharge from the funnel (2), terminating in a technical throttling principle (27). The shell falls into a channel (3), in fact on a dedicated conveyor. A sort of rectangular or square channel, corresponding to the form of the block formed (9*b*). This channel being a little wider than the end of the narrow passage (27) of the funnel. The shell opens a little more. Mechanically, the shell cannot go back up again. The ram (10), providing a thrust on the bottom (12) and driving towards the bottom of the funnel (27), can therefore return to its starting point without returning the shell with it, in the funnel (2). At this precise moment, the shell thus having slightly inclined walls, a little more open, because of the channel that is a little more separated or splayed, at the wall, than the end of the narrow passage of the funnel, is therefore released for another operation. The shell can no longer rise up in the funnel and follow the reverse path. This operating principle is obviously equivalent with a traction solution (16*b*).

The solution of the pusher (10), making it possible to effect, by way of a foot (22), a pressure on the bottom of the sheet (22), therefore forms part of the invention claimed. In this way pushing the sheet in the funnel by pressure (16*a*) so that it is deformed, in accordance with the grooves disposed for this purpose on the sheet (9*a*). However, it is also possible to work by a suction system. Consequently the attraction solution (16*b*) also forms part of the invention, by pulling the cardboard sheet into the funnel, instead of pushing it.

The suction system is therefore a complementary solution. The form of the funnel remains the same but, instead of pushing, pulling is carried out. By way of a suction tube with suckers for example or by any other ways for this purpose. The suction tube enters the funnel, from below, through a narrow passage provided for this purpose and then is pressed against the rectangle or square (12), intended to be the bottom of the future shell. Once the shell is gripped by the suction suckers, any ram will draw the future shell towards the narrow passage (27). Naturally, just like the pressure system (16*a*), the corners (7) deform with the acute angles (5), the rounded parts in the funnel (12), drawing towards the inside in the narrow passage. The grooves (6*a*) on the sheet, intended to make the corners of the shell by way of two triangles or angles, enter the future shell, and are fitted while being folded towards the centre. Next the four sides (8) are lifted, by way of the grooves (6*b*), aided by the four slides (11) that bring the four sides (8) together so that this future shell developing in accordance with (9*a*), (9*b*), (9*c*) and (9*d*) ends its passage in the final narrow part (27) of the funnel. The thrust is no longer effected on the sheet of the future block, bearing in the bottom, but this is done from the outside, by way of any suction system making it possible to effect a traction on the outside of the shell. By sucking the external bottom (12) of the shell serving as an attachment. Next the shell ends its travel under the same conditions as the pushing formula. A sufficient passage for the removable tube or the suction ram to be able to be released without taking away the shell is simply provided in the shell, the shell being much larger than it and therefore not able to pass. The shell therefore remains on the conveyor (3).

According to the preferred but not limitative embodiment, said deformation system directed, by pressure or traction, in a system of the funnel type, mechanised or not, is therefore an innovative and novel essential element. However, the machine has other aspects that are innovative, novel and industrially applicable.

In FIG. 1, once the shell is formed, it falls into a channel or conveyor (3). The shell (9*d*) is formed by way of the edges since it has not yet received its locking key. This channel can therefore be equipped with automatic conveyor systems (3) in order to make the shells (9*d*) travel to another assembly station on the machine, that is to say (2), towards (3), being the conveyor, for placing the cross bar or for gluing, and then to (4) for closure of the block.

The step of the conveyor (3) makes it possible to install cross bars in order to reinforce the block (9*d*). The cross bar can be placed by way of a robotic system already existing on the industrial machine market or manually. Automatic gluing stations can be added during the conveying time. For example, glue can be injected into the block, in any form, before the final closure with the locking key. In this case, the block is therefore optionally non-demountable. It is also possible to install therein a printing module on the conveyor (3).

The shaft (16) is a guide system and the locking key is introduced therein. The four flaps (17) of the locking key are therefore folded and introduced first towards the inside of the shaft. Naturally the four flaps (17) have a tendency to open outwards by way of the memory effect of the sheet, wishing to resume its initial form. During descent, the flaps are pressed against the internal walls of the shaft.

By way of a thrust ram (20) of the hydraulic, pneumatic, electrical or manual type, in fact any type of suitable and non-limitative solution, serving as sufficient thrust. This makes it possible to guide and lower the locking chock as far as the chocked shell (9*d*) under the shaft in order to proceed with the fitting (21). The locking chock (15*b*) naturally enters the shell (9*d*) with or without a reinforcing cross bar (19*a*) or (19*b*).

FIG. 7 also presents the fitting taking place under the shaft (21). (15*b*) enters (9*b*) or (9*d*).

In FIG. 12, the block (14, constructed and finished, emerges from the conveyor after having followed the three major assembly steps with the modules (2), (3), (4) of the machine (1) but not being limitative since it is possible to add stations such as gluing or printing on the conveyor (3).

The invention is particularly remarkable through the fact that a person skilled in the art had not until the present time thought of deforming cardboard by way of a vertical pressure, a so-called funnel and a mechanical throttling system to form shells for example, exerting thereon a positive or negative thrust. Making pressure device act on the bottom (12) in order to construct cardboard blocks or with any other material lending itself thereto. The material of the corrugated cardboard type is taken by preference as an example but is not limitative.

The system is particularly innovative and novel through the fact of using, in addition to the funnel system, a vertical pressure device for helping the cardboard to deform (16*a*) and (16*b*), in order to enter said funnel and to make it travel towards the narrow exit (27). We can call that "a directed deformation, from any rigid sheet, prepared for this purpose".

The system is particularly inventive and open to development since it is possible to work by way of traction (16*b*) by placing for example a sucker system, sucking the so-called rigid cardboard sheet. A sheet secured by a sucker or suckers, by way of pumping for example, thus making it possible to pull it towards the bottom of said funnel (27).

The invention claimed is:

1. A device for manufacturing a block comprising a locking key and a folded shell that is scored and/or pre-grooved, said device comprising:

a first device that includes:

at least one shaping device comprising a funnel having side folding elements and corner folding elements that protrude inwardly and that are located at corners of the funnel;

said corner folding elements including diagonally located corner folding elements that face toward each other; and at least a pressing element or a traction element being configured to apply a pressing or traction force to a center of a sheet element; said at least one shaping device having an open bottom, the pressing element or the traction element passing into said at least one shaping device and through the open bottom;

said side and corner folding elements of the funnel of the at least one shaping device being configured, in response to said pressing or traction force, to shape the sheet element into the folded shell with corner edges of the sheet element protruding inwardly by the corner folding elements of the funnel and with the sides of the sheet element extending vertically;

said funnel being configured to gradually shape the folded shell into a cubic shape as the folded shell descends and diagonally arranged corner edges of the folded shell face toward each other and are angled away from adjacent sides of the folded shell; and a second device that includes at least a pressing element configured to insert the locking key into said folded shell to form said block.

2. The device of claim 1, wherein said block is formed without need of glue, adhesive or staples.

3. The device of claim 1, wherein the funnel is a rectangular funnel.

4. The device of claim 1, further comprising a conveyor configured to receive the folded shell.

5. The device of claim 1, wherein the pressing element is an electromechanical vertical pressing element.

6. The device of claim 1, wherein the traction element is an electromechanical vertical traction element.

7. The device of claim 1, wherein the pressing element is a ram and the at least one shaping device has curved shaping elements.

8. The device of claim 1, wherein the at least one shaping device has rollers.

9. The device of claim 1, wherein the at least one shaping device functions independently of a conveyor that conveys the folded shell to the second device.

10. A method of manufacturing a block utilizing the device of claim 1, the method comprising:

shaping, utilizing the first device and the at least one shaping device, a sheet element into the folded shell so corner edges of the sheet element are folded inwardly and sides of the sheet element are vertically positioned after the first device applies a force to a center of a bottom side of the flat element; and inserting the locking key into said folded shell to form said block using the second device.

11. The method of claim 10, further comprising guiding the locking key down into the folded shell using a hollow shaft of the second device.

12. The method of claim 10, further comprising guiding the locking key down into the folded shell using constant pressure.

13. The method of claim 10, further comprising folding the locking key prior to inserting the locking key into the folded shell, wherein, during the guiding, flaps of the locking key pressed against walls of the shaft.

14. The method of claim 10, further comprising, prior to the inserting, conveying with a conveyor the folded shell to the second device.

15. The method of claim 14, wherein the folded shell is conveyed to the second device while retaining the cubic shape.

16. The method of claim 10, further comprising, prior to the inserting, inserting a reinforcement element in the folded shell.

17. The method of claim 10, further comprising, prior to the inserting, inserting a reinforcement element in the folded shell while the folded shell is arranged on a conveyor.

18. The device of claim 1, wherein the corner folding elements comprises four internal rounded protrusions located at an upper end of the at least one shaping device and each of said four internal rounded protrusions are configured to fold two adjacent symmetrically shaped corners of the folded shell so the two adjacent symmetrically shaped corners are arranged parallel to one another and extend at an acute angle relate to adjacent sides of the folded shell.

19. The device of claim 1, wherein each of the sheet folding protrusions protrude inwardly relative to two adjacent side folding elements and the corner edges of the folded shell are configured to be folded inwardly by the corner folding elements such that symmetrically shaped corner portions of the folded shell have surfaces arranged adjacent and parallel one another and are oriented diagonally and at an acute angle relative to adjacent sides of the folded shell.

* * * * *